US008436776B2

(12) United States Patent
Suh et al.

(10) Patent No.: US 8,436,776 B2
(45) Date of Patent: May 7, 2013

(54) NEAR-HORIZON ANTENNA STRUCTURE AND FLAT PANEL DISPLAY WITH INTEGRATED ANTENNA STRUCTURE

(75) Inventors: Seong-Youp Suh, San Jose, CA (US); Anand S. Konanur, Sunnyvale, CA (US); Songnan Yang, San Jose, CA (US); Salih Yarga, Columbus, OH (US)

(73) Assignee: Intel Corporation, Santa Clara, CA (US)

( * ) Notice: Subject to any disclaimer, the term of this patent is extended or adjusted under 35 U.S.C. 154(b) by 454 days.

(21) Appl. No.: 12/533,140

(22) Filed: Jul. 31, 2009

(65) Prior Publication Data

US 2011/0025566 A1 Feb. 3, 2011

(51) Int. Cl.
*H01Q 1/38* (2006.01)
*H01Q 1/24* (2006.01)

(52) U.S. Cl.
USPC ..... 343/702; 343/700 MS; 343/795

(58) Field of Classification Search ..... 343/700 MS, 343/702, 826, 828, 829, 830, 846, 848, 795
See application file for complete search history.

(56) References Cited

U.S. PATENT DOCUMENTS 5,418,543 A * 5/1995 Bolton ..... 343/713
7,864,116 B2 * 1/2011 Kurashima et al. .... 343/700 MS

* cited by examiner

*Primary Examiner* — Michael C Wimer
(74) *Attorney, Agent, or Firm* — Schwegman, Lundberg & Woessner, P.A.

(57) ABSTRACT

A near-horizon antenna structure includes an upper radiating element having a straight conductive trace disposed on a planar surface of a non-conductive substrate, a rectangular lower radiating element serving as a ground plane disposed on the planar surface, and a feed point provided between the upper and lower radiating elements. When the planar surface is positioned vertically, the far-field effects of horizontal current flowing in opposite directions on the radiating elements cancel to provide an antenna pattern with increased gain in horizontal directions and reduced gain in vertical directions. A flat panel display and a portable communication device are also provided with one or more near-horizon antenna structures integrated therein.

20 Claims, 6 Drawing Sheets

NEAR-HORIZON ANTENNA (FRONT VIEW)

NEAR-HORIZON ANTENNA (FRONT VIEW)

FAR FIELD PATTERN

FAR FIELD PATTERN (3-D ILLUSTRATION)

FLAT PANEL DISPLAY WITH INTEGRATED ANTENNA STRUCTURES

WIRELESS COMMUNICATION DEVICE

NEAR-HORIZON ANTENNA STRUCTURE AND FLAT PANEL DISPLAY WITH INTEGRATED ANTENNA STRUCTURE

TECHNICAL FIELD

Embodiments pertain to antennas and antenna structures. Some embodiments pertain to flat panel displays with integrated antennas. Some embodiments pertain to portable computing devices, such as a laptop, notebook and netbook computers, with integrated antennas configured to communicate with wireless network base stations and access points. Some embodiments pertain to Worldwide Interoperability for Microwave Access (WiMAX) devices that communicate in accordance with one of the IEEE 802.16 standards.

BACKGROUND

Portable computing and communication devices, such as laptop, notebook and netbook computers, are generally configured with wireless capability and include one or more internal antennas to communicate with access points or base stations. These internal antennas generally provide an antenna pattern with similar gain in both vertical and horizontal directions. Because access points and base stations are generally located in a more horizontal direction, much of the gain of these antennas is wasted in the vertical direction. An internal antenna with an increased gain in the horizontal direction and reduced gain in the vertical direction (i.e., a more donut shaped radiation pattern) would be more suitable for use in portable computing and communication devices, however conventional antennas are generally unable to provide such a radiation pattern due to form factor restrictions.

Thus, there are general needs for antenna structures based on a pattern-synthesis approach that are suitable for portable computing and communication devices that provide increased directivity in the horizontal direction. There are also needs for flat panel displays and planar antenna structures that provide increased directivity in the horizontal direction suitable for integration into flat panel displays.

DETAILED DESCRIPTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Figure 1:
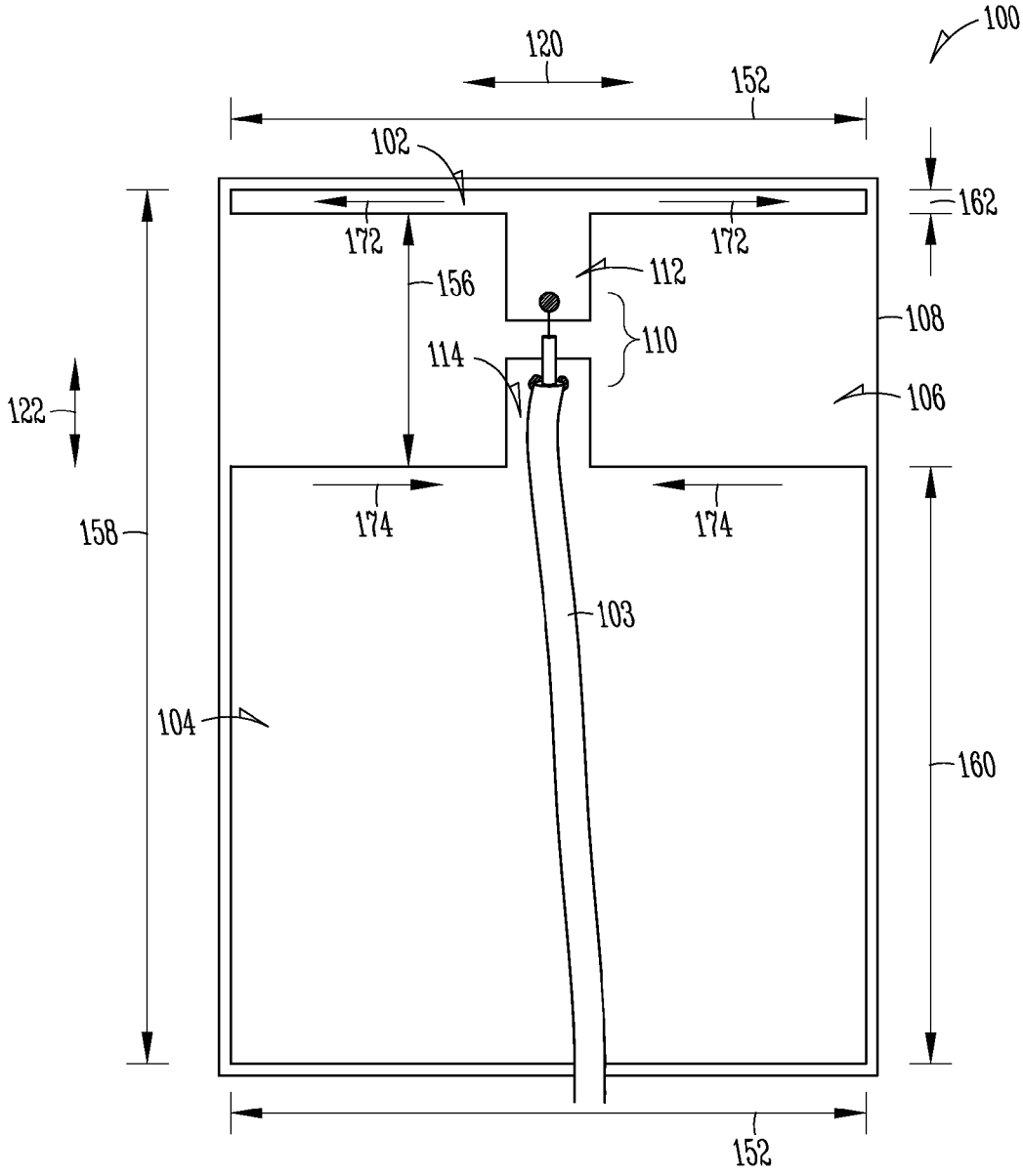
FIG. 1 is a front view of a near-horizon antenna in accordance with some embodiments.

FIG. 1 is a front view of a near-horizon antenna in accordance with some embodiments. Near-horizon antenna structure 100 comprises an upper radiating element 102, a rectangular lower radiating element 104 and a feed point 110. The upper radiating element 102 comprises a straight conductive trace disposed on a planar surface 106 of a non-conductive substrate 108. The rectangular lower radiating element 104 serves as a ground plane and may also be disposed on the planar surface 106. The feed point 110 is provided between the upper radiating element 102 and the lower radiating element 104. When the planar surface 106 is positioned vertically, the far-field effects of current flowing in opposite directions 172 on the upper radiating element 102 cancel and the far-field effects of current flowing in opposite directions 174 on the lower radiating element 104 cancel. This provides an antenna pattern with increased gain in horizontal directions 120 and reduced gain in vertical directions 122. The planar configuration of antenna structure 100 allows it to meet the form factor restrictions of the flat panel displays used in portable computing and communication devices.

In accordance with embodiments, the upper radiating element 102 and the lower radiating element 104 are provided in a planar configuration in a same plane as the planar surface 106 of the non-conductive substrate 108. The rectangular lower radiating element 104 may be provided on the planar surface 106 below the upper radiating element. The rectangular lower radiating element 104 may be used to match the antenna structure 100 to 50 Ohms which may allow the antenna structure 100 to be used without a matching network. In these embodiments, the dimensions of the various elements are selected for impedance matching and to provide the donut-shaped radiation pattern.

The antenna structure 100 may also include rectangular conductive regions 112 and 114 disposed on the planar surface 106 to couple the feed point 110 to mid-points of the radiating elements. The feed point 110 is configured to allow an input signal path, such as a coaxial cable 103 to be coupled (e.g., soldered) to the rectangular conductive regions 112 and 114 to couple opposite phased signals from the feed point 110 to the upper radiating element 102 and the lower radiating element 104 to provide the current flowing in opposite directions on the upper and lower radiating elements. As illustrated in FIG. 1, rectangular conductive region 112 couples the feed point 110 to the center of the upper radiating element 102, and rectangular conductive region 114 couples the feed point 110 to the center of the radiating element 104.

In some embodiments, the non-conductive substrate 108 may comprise a printed circuit board (PCB) and the upper and lower radiating elements are provided on a first side of the printed circuit board. The opposite side (e.g., the back surface) of the printed circuit board is devoid of conductive material at least in regions opposite the upper radiating element 102. In these embodiments, the antenna structure 100 is a planar structure suitable for fabrication on a planar non-conductive substrate, such as non-conductive substrate 108. In some embodiments, conductive material may be provided or printed on the back side of non-conductive substrate 108 opposite the lower radiating element 104, although this is not a requirement. When the antenna structure 100 is provided as part of a flat panel display, a thin-sheet insulator may be provided to isolate the conductive material provided on the non-conductive substrate 108 from conductive elements of the flat panel display.

In some embodiments, the upper radiating element 102 and the lower radiating element 104 have approximately equal width dimensions 152. The lower radiating element 104 has a height dimension 160 substantially greater (e.g., approximately 26 times greater) than a height dimension 162 of the upper of radiating element 102. A vertical separation distance 156 between the upper and lower radiating elements may be selected to be a small fractional of a wavelength to provide an antenna pattern with a donut shape over a broad bandwidth. Although in FIG. 1, the upper and lower radiating elements are illustrated as having approximately equal width dimensions 152, the scope of the embodiments are not limited in this respect. The width dimension of the upper and lower radiating elements may differ depending on the form factor of the device in which the antenna structure is part of.

In some embodiments, the upper radiating element 102 and the lower radiating element 104 have width dimensions 152 in the horizontal directions 120 of approximately a quarter-wavelength of the frequency of operation. The vertical separation distance 156 may be no greater than approximately 0.06 wavelengths. The vertical separation distance 156 may be selected to provide a consistent donut shaped antenna pattern over the broad bandwidth. In these embodiments, the selection of a very small vertical separation distance 156 (a small fraction of a wavelength) allows the antenna structure 100 to provide a consistent donut shaped antenna pattern over a broad bandwidth (e.g., 2.5 to 3.8 GHz).

In some embodiments, the rectangular conductive regions 112 and 114 that couple the feed point 110 to centers of the radiating elements have a width dimension in the horizontal direction of approximately 0.02 wavelengths, the upper radiating element 102 may have a height dimension 162 in a vertical direction of approximately 0.01 wavelengths, and the lower radiating element 104 may have a height dimension 160 in the vertical direction of approximately 0.26 wavelengths. A height dimension 158 of the antenna structure in the vertical direction may be approximately one third wavelengths. The height dimension 158 of the antenna structure may be the sum of the height dimension 160 of the lower radiating element 104, the vertical separation distance 156, and the height dimension 162 of the upper radiating element 102. In some embodiments, the width dimensions 152 are approximately 30 millimeters (mm), the height dimension 158 is approximately 40 mm and the thickness is approximately 0.25 mm.

In some embodiments, the dimensions of the elements of the antenna structure 100 may be selected so that the antenna pattern has an increased gain just above the horizon. For example, the elements of the antenna structure 100 may be selected so that the antenna pattern has an increased gain at between approximately −10 and +15 degrees with respect to the horizon or horizontal plane. This increased gain may generally be in a direction to the antennas of a WiMAX base station. In these embodiments, the increased size of the lower radiating element 104 may be selected to provide an increased gain slightly above the horizon.

In some embodiments, the non-conductive substrate 108 may comprise almost any dielectric or insulating material including both flexible and rigid materials. In some embodiments, the non-conductive substrate 108 may comprise a flexible polyethylene terephtalate (PET) substrate. The conductive material may comprise copper, which may be in the form of a thin copper foil, although other conductive materials are suitable.

Figure 2:
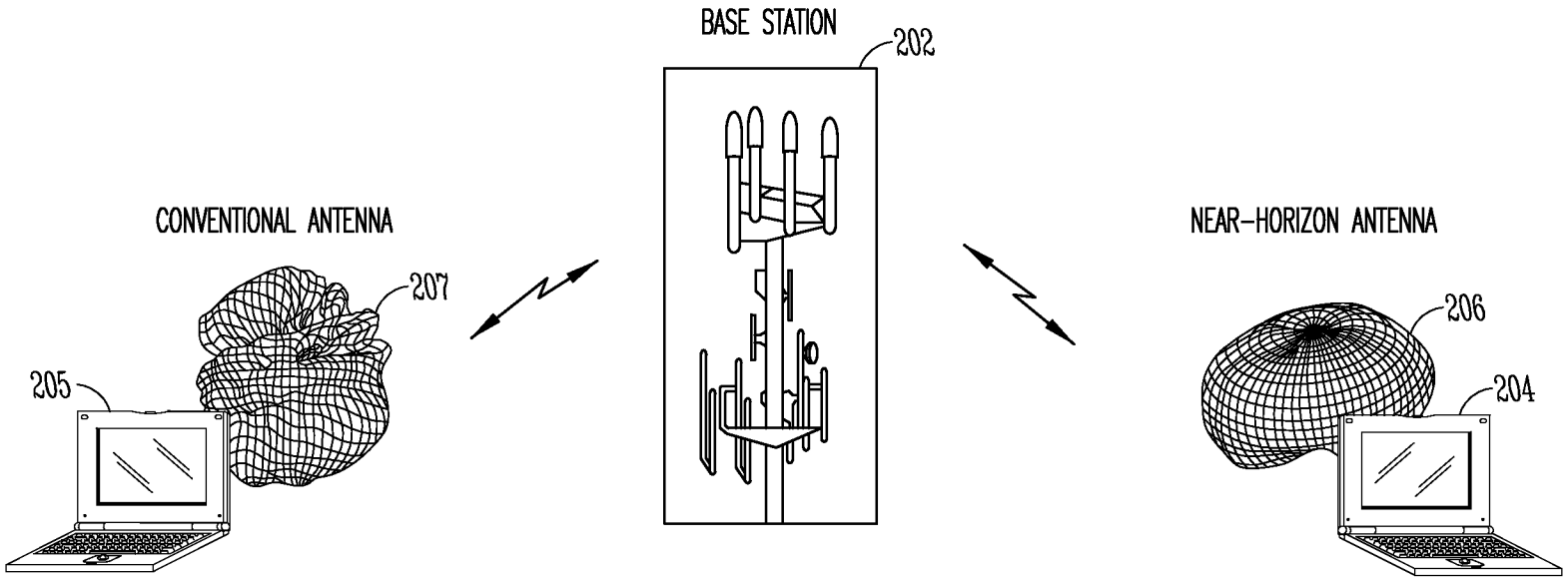
FIG. 2 is a comparison between antenna patterns of a conventional antenna and an antenna pattern of the near-horizon antenna of FIG. 1 in accordance with some embodiments.

FIG. 2 is a comparison between antenna patterns of a conventional antenna and an antenna pattern of the near-horizon antenna of FIG. 1 in accordance with some embodiments. Portable communication device 204 may include one or more near-horizon antenna structures, such as near-horizon antenna structure 100 (FIG. 1), for communicating with base station 202. Portable communication device 205 may include a conventional antenna structure for communicating with base station 202. The antenna pattern 206 provided by near-horizon antenna structure 100 of portable communication device 204 has increased gain in the horizontal directions and reduced gain in the vertical directions allowing for more gain in the direction of the base station 202. The antenna pattern 207 provided by the conventional antenna structure of portable communication device 205 does not have provide more gain in the direction of the base station 202.

In some embodiments, base station 202 may be a WiMAX base station and portable communication device 204 may include a WiMAX transceiver for communicating with the WiMAX base station. These embodiments are discussed in more detail below.

Figure 3:
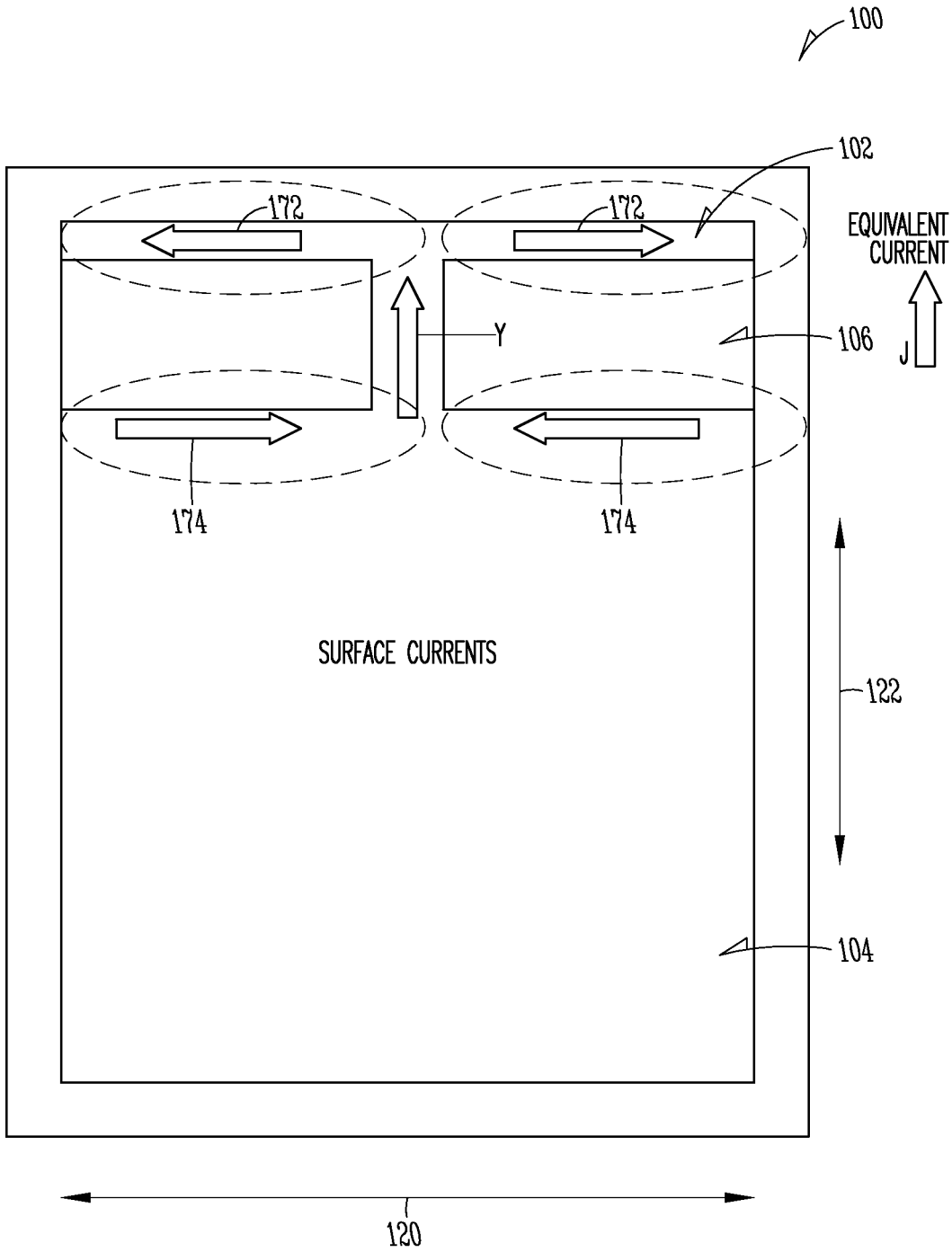
FIG. 3 illustrates surface currents present on the near-horizon antenna of FIG. 1 in accordance with some embodiments.

FIG. 3 illustrates surface currents present on the near-horizon antenna 100 (FIG. 1) in accordance with some embodiments. As illustrated in FIG. 3, when the planar surface 106 is positioned vertically and when the straight conductive trace of the upper radiating element 102 is positioned horizontally, the far-field effects of current flowing horizontally in opposite directions 172 on the upper radiating element 102 away from the feed point 110 (FIG. 1) and the far field effects of current flowing horizontally in opposite directions 174 on the lower radiating element 104 toward the feed point 110 cancel to provide an antenna pattern with increased gain in the horizontal directions 120 and reduced gain in the vertical directions 122. As discussed above, the donut-shaped radiation pattern allows for more gain in the direction of a base station 202 (FIG. 2).

Figure 4:
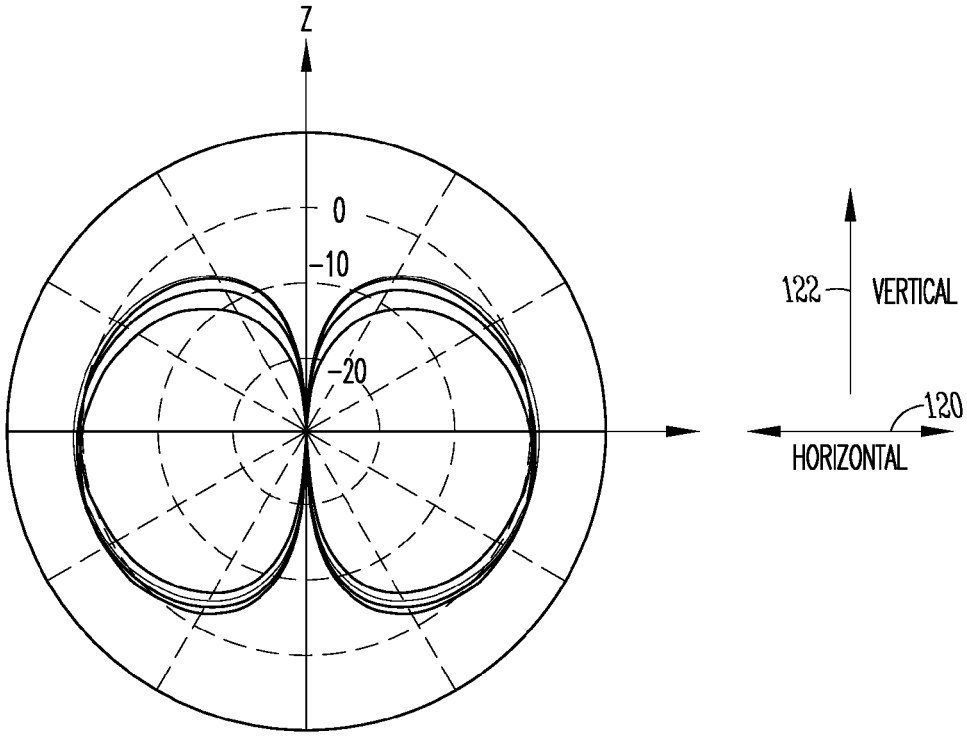
FIG. 4 is a graph of the far-field pattern of the near-horizon antenna of FIG. 1 in accordance with some embodiments.

FIG. 4 is a graph of the far-field pattern of the near-horizon antenna 100 (FIG. 1) in accordance with some embodiments. The vector sum of the currents (i.e., currents in opposite directions 172 (FIG. 3) and currents in opposite directions 174 (FIG. 3)) in horizontal directions 120 is very small or close to zero which provides a maxima in horizontal directions 120 and which provides nulls in vertical directions 122 (i.e., toward the ground (i.e., the nadir) and sky (i.e., the zenith)). As illustrated in FIG. 4, the effects of the opposite flowing horizontal surface currents cancel in the far field and result in the donut-shaped radiation pattern.

Figure 5:
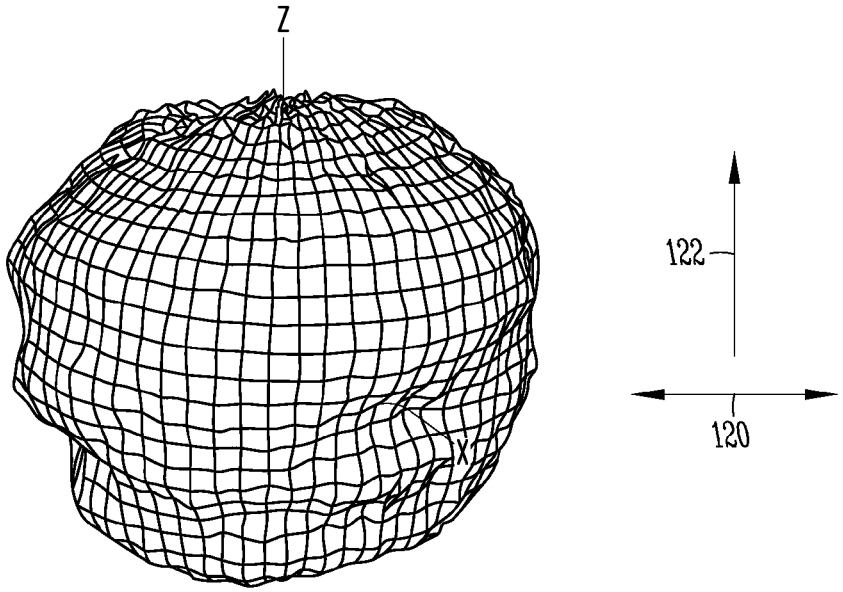
FIG. 5 is a three-dimensional illustration of the far-field pattern of the near-horizon antenna of FIG. 1 in accordance with some embodiments.

FIG. 5 is a three-dimensional illustration of the far-field pattern of the near-horizon antenna (FIG. 1) in accordance with some embodiments. The far-field antenna pattern illustrated in FIG. 5 shows increased gain in horizontal directions 120 and reduced gain in vertical directions 122.

Figure 6:
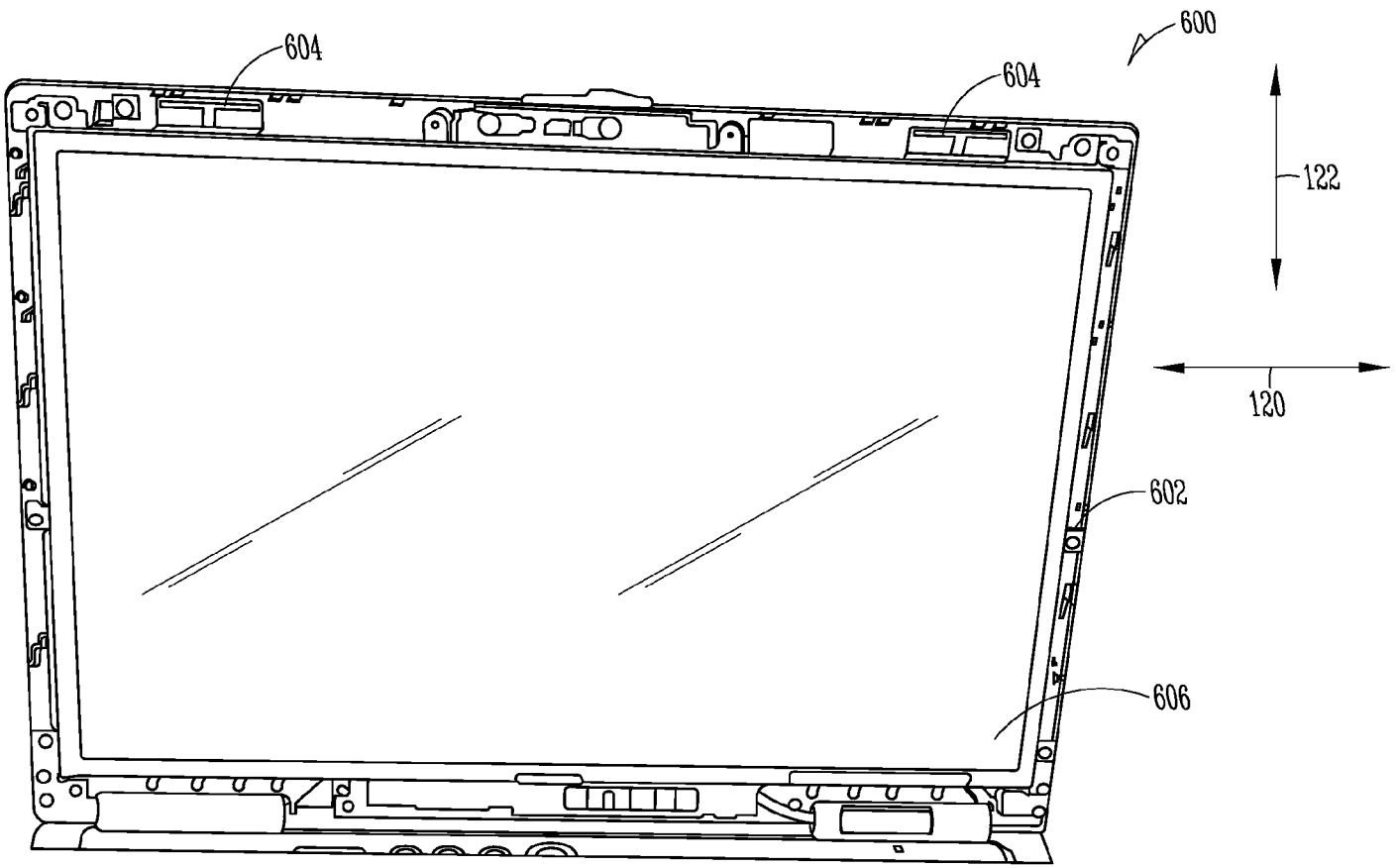
FIG. 6 is a flat panel display with integrated antenna structures in accordance with some embodiments.

FIG. 6 is a flat panel display with integrated antenna structures in accordance with some embodiments. Flat panel display 600 comprises a housing 602, a flat display area 606, and one or more antenna structures 604 provided within the housing 602. Antenna structure 100 (FIG. 1) may be suitable for use as each of the antenna structures 604 and may include the upper radiating element 102 (FIG. 1), the rectangular lower radiating element 104 (FIG. 1) and the feed point 110. In these embodiments, when the flat display area 606 and the planar surface 106 (FIG. 1) of antenna structures 604 are positioned vertically, the far-field effects of horizontal current flowing in opposite directions cancel to provide an antenna pattern with increased gain in horizontal directions 120 and reduced gain in vertical directions 122.

In some embodiments, at least part of the ground planes of the antenna structures 604 is located behind the flat display area 606. When the flat display area 606 is positioned vertically, the upper radiating element 102 is located above the display area 606. The plane of the flat display area 606 and the planar surface 106 of the antenna structure are substantially parallel, and the ground planes of the antenna structures 604 may be electrically isolated from the ground plane of the display area 606. In some embodiments, a thin-sheet insulator may be included to electrically isolate the ground plane of the antenna structure 604 from the ground plane of the display area 606.

In some embodiments, the flat panel display 600 may include two or more of the antenna structures 604 configured to operate in accordance with a multiple-input multiple output (MIMO) communication technique. In some alternate embodiments, the two or more of the antenna structures 604 may be configured or positioned to operate as a phased array, although the scope of the embodiments is not limited in this respect.

In some embodiments, the flat panel display 600 may be a stand-alone display. In these embodiments, flat panel display 600 may, for example, serve as a display for a desktop computer or television. In some other embodiments, the flat panel display 600 may be a part of a portable communication device (e.g., a notebook or netbook computer, a wireless telecommunication device), such as portable communication device 204 (FIG. 2). In some embodiments, the flat display area 606 may comprise a liquid-crystal display (LCD), although other types of flat display areas are also suitable.

In these embodiments, when the display is opened, the flat display area 606 and the planar surface 106 may be positioned vertically. This may provide an antenna pattern with increased gain in horizontal directions 120 and reduced gain in vertical directions 122 for improved communication with a base station or an access point.

In some embodiment, notebook computer with the integrated antenna structures 604 is provided. The notebook computer may comprise the flat panel display 600 having the housing 602, the flat display area 606, and the one or more antenna structures 604 provided within the housing 602. The notebook computer may also include a wireless transceiver coupled to the one or more antenna structures 604. Antenna structure 100 (FIG. 1) may be suitable for use as each of the one or more antenna structures 604 and may provide an antenna pattern with increased gain in horizontal directions 120 and reduced gain in vertical directions 122. In some embodiments, the notebook computer may be a wireless communication device such as a netbook computer configured primarily for wireless network communications and may primarily rely on online applications, although the scope of the embodiments is not limited in this respect. These embodiments are described in more detail below.

Figure 7:
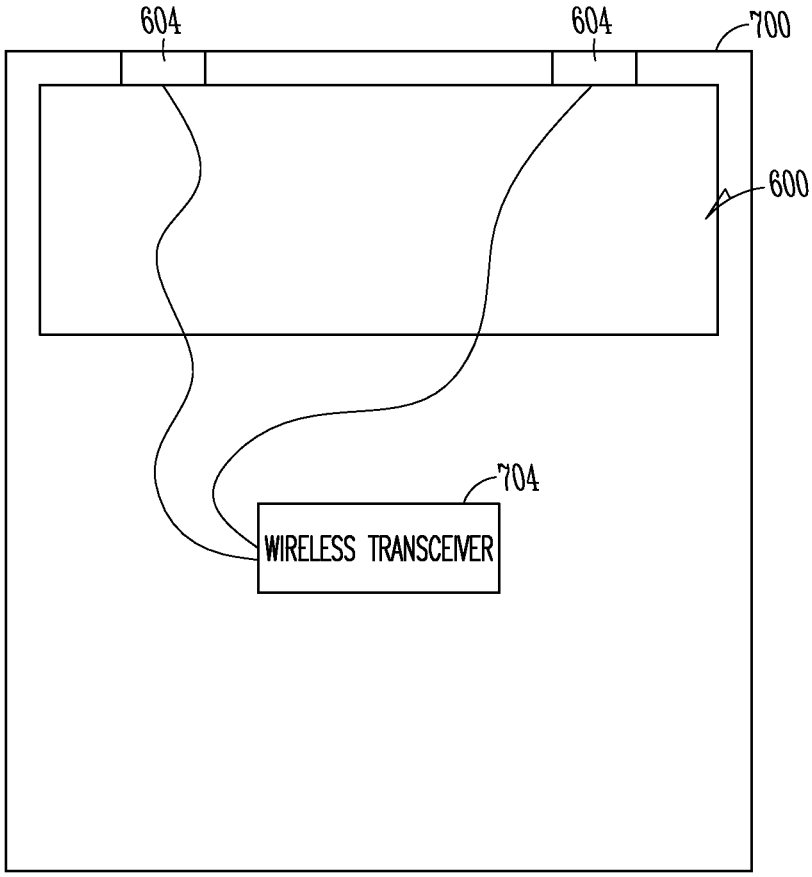
FIG. 7 is a block diagram of a wireless communication device in accordance with some embodiments.

FIG. 7 is a block diagram of a wireless communication device in accordance with some embodiments. Wireless communication device 700 may include wireless transceiver 704, one or more antenna structures 604 and flat panel display 600, such as the one or more antenna structures 604 and flat panel display 600 illustrated in FIG. 6.

Wireless communication device 700 may be almost any device configured for wireless communication, such as a personal digital assistant (PDA), a laptop or portable computer with wireless communication capability, a notebook or netbook computer, a web tablet, a wireless telephone, a wireless headset, a pager, an instant messaging device, a digital camera, an access point, a television, a medical device (e.g., a heart rate monitor, a blood pressure monitor, etc.), or other device that may receive and/or transmit information wirelessly.

In some embodiments, the wireless transceiver 704 may be configured to communicate orthogonal frequency division multiplexed (OFDM) communication signals over a multicarrier communication channel. The OFDM signals may comprise a plurality of orthogonal subcarriers. In some of these multicarrier embodiments, the wireless transceiver 704 may be part of a wireless local area network (WLAN) communication station such as a wireless access point (AP), base station or a mobile device including a Wireless Fidelity (WiFi) device. In some broadband multicarrier embodiments, the wireless transceiver 704 may be part of a broadband wireless access (BWA) network communication station, such as a Worldwide Interoperability for Microwave Access (WiMAX) communication station. In some other broadband multicarrier embodiments, the wireless transceiver 704 may be a 3rd Generation Partnership Project (3GPP) Universal Terrestrial Radio Access Network (UTRAN) Long-Term-Evolution (LTE) or a Long-Term-Evolution (LTE) communication station, although the scope of the embodiments is not limited in this respect. In these broadband multicarrier embodiments, the wireless transceiver 704 may be configured to communicate in accordance with an orthogonal frequency division multiple access (OFDMA) technique.

In some embodiments, the wireless transceiver 704 may be configured to receive signals in accordance with specific communication standards, such as the Institute of Electrical and Electronics Engineers (IEEE) standards including IEEE 802.11-2007 and/or 802.11(n) standards and/or proposed specifications for WLANs, although the scope of the embodiments is not limited in this respect as they may also be suitable to transmit and/or receive communications in accordance with other techniques and standards. In some embodiments, the wireless transceiver 704 may be configured to communicate signals in accordance with the IEEE 802.16-2004 and the IEEE 802.16(e) standards for wireless metropolitan area networks (WMANs) including variations and evolutions thereof, although the scope of the embodiments is not limited in this respect as they may also be suitable to transmit and/or receive communications in accordance with other techniques and standards. For more information with respect to the IEEE 802.11 and IEEE 802.16 standards, please refer to "IEEE Standards for Information Technology—Telecommunications and Information Exchange between Systems"—Local Area Networks—Specific Requirements—Part 11 "Wireless LAN Medium Access Control (MAC) and Physical Layer (PHY), ISO/IEC 8802-11: 1999", and Metropolitan Area Networks—Specific Requirements—Part 16: "Air Interface for Fixed Broadband Wireless Access Systems," May 2005 and related amendments/versions. For more information with respect to UTRAN LTE standards, see the 3rd Generation Partnership Project (3GPP) standards for UTRAN-LTE, release 8, March 2008, including variations and evolutions thereof.

In some other embodiments, the wireless transceiver 704 may be configured to receive signals that were transmitted using one or more other modulation techniques such as spread spectrum modulation (e.g., direct sequence code division multiple access (DS-CDMA) and/or frequency hopping code division multiple access (FH-CDMA)), time-division multiplexing (TDM) modulation, and/or frequency-division multiplexing (FDM) modulation, although the scope of the embodiments is not limited in this respect.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A near-horizon antenna structure comprising:

an upper radiating element comprising a straight conductive trace disposed on a planar surface of a non-conductive substrate;

a rectangular lower radiating element separated from the upper radiating element by a vertical separation distance, and a rectangular conductive region disposed on the planar surface, the rectangular conductive region coupled to the rectangular lower radiating element and protruding from the rectangular lower radiating element, the rectangular lower radiating element serving as a ground plane disposed on the planar surface, wherein the rectangular lower radiating element has a height greater than one-half of a height of the substrate, and the vertical separation distance is no greater than 0.06 wavelengths to provide an antenna pattern having donut-shape over a bandwidth from 2.5 to 3.8 GHz; and a feed point provided between the upper and lower radiating elements;

wherein when the planar surface is positioned vertically, far-field effects of current flowing in opposite directions on the upper radiating element cancel and far-field effects of current flowing in opposite directions on the lower radiating element cancel to provide the antenna pattern with increased gain in horizontal directions and reduced gain in vertical directions.

2. The antenna structure of claim 1 wherein the upper and lower radiating elements are provided in a planar configuration in a same plane as the planar surface, and wherein when the planar surface is positioned vertically and when the straight conductive trace of the upper radiating element is positioned horizontally, the antenna pattern having the donut-shaped radiation pattern having increased gain in the horizontal directions and reduced gain in the vertical directions is provided.

3. The antenna structure of claim 2 further comprising an additional rectangular conductive region and disposed on the planar surface to couple the feed point to a mid point of the straight conductive trace, wherein the rectangular conductive region couples the feed point to a mid point of the rectangular lower radiating element, wherein the feed point is configured to allow an input signal path to be coupled to the rectangular conductive regions and to couple opposite phased signals from the feed point to the upper and lower radiating elements to provide the current flowing in opposite directions on the upper and lower radiating elements.

4. The antenna structure of claim 3 wherein the non-conductive substrate comprises a printed circuit board, wherein the upper and lower radiating elements are provided on a first side of the printed circuit board, and wherein an opposite side of the printed circuit board is devoid of conductive material at least in regions opposite the upper radiating element.

5. The antenna structure of claim 4 wherein the upper and lower radiating elements have approximately equal width dimensions, wherein the lower radiating element has a height dimension substantially greater than a height dimension of the upper radiating element.

6. The antenna structure of claim 5 wherein:

the upper and lower radiating element and have a width dimension in a horizontal direction of a quarter-wavelength.

7. The antenna structure of claim 5 wherein the dimensions of the elements of the antenna structure are selected so that the antenna pattern has an increased gain just above the horizon.

8. The antenna structure of claim 1 wherein the non-conductive substrate is a flexible polyethylene terephtalate (PET) substrate.

9. A flat panel display with integrated antenna structures comprising:

a housing;

a flat display area; and one or more antenna structures provided within the housing, wherein the one or more antenna structures comprise an upper radiating element, a rectangular lower radiating element separated from the upper radiating element by a vertical separation distance, and a feed point, wherein the upper radiating element comprises a straight conductive trace disposed on a planar surface of a non-conductive substrate, a rectangular conductive region disposed on the planar surface, the rectangular conductive region coupled to the rectangular lower radiating element and protruding from the rectangular lower radiating element the rectangular lower radiating element serving as a ground plane and disposed on the planar surface, the feed point provided between the upper and lower radiating elements, wherein the rectangular lower radiating element has a height greater than one-half of a height of the substrate, and the vertical separation distance is no greater than 0.06 wavelengths to provide an antenna pattern having donut-shape over a bandwidth from 2.5 to 3.8 GHz, and wherein when the flat display area and the planar surface are positioned vertically, far-field effects of current flowing in opposite directions on the upper radiating element cancel and far-field effects of current flowing in opposite directions on the lower radiating element cancel to provide the antenna pattern with increased gain in horizontal directions and reduced gain in vertical directions.

10. The flat panel display of claim 9 wherein at least part of the ground plane of the antenna structure is located behind the flat display area, wherein when the flat display area is positioned vertically, the upper radiating element is located above the display area, wherein a plane of the flat display area and the planar surface of the one or more antenna structures are substantially parallel, and wherein the ground plane of the antenna structure is electrically isolated from a ground plane of the display area.

11. The flat panel display of claim 10 further comprising a thin-sheet insulator to electrically isolate the ground plane of the antenna structure from a ground plane of the display area.

12. The flat panel display of claim 10 wherein the upper and lower radiating elements of the antenna structure are provided in a planar configuration in a same plane as the planar surface, and wherein when the planar surface is positioned vertically and when the straight conductive trace of the upper radiating element is positioned horizontally, the antenna pattern having a donut-shaped radiation pattern with increased gain in the horizontal directions and reduced gain in the vertical directions is provided.

13. The flat panel display of claim 10 wherein the flat display area comprises a liquid-crystal display (LCD).

14. The flat panel display of claim 10 wherein the flat panel display is a stand-along display.

15. The flat panel display of claim 10 wherein the flat panel display is a part of a portable communication device, wherein when the flat panel display is opened, the flat display area and the planar surface are positioned vertically to provide the antenna pattern with increased gain in horizontal directions and reduced gain in vertical directions, and wherein the display comprises two or more of the antenna structures configured to operate in accordance with a multiple-input multiple output (MIMO) communication technique.

16. The flat panel display of claim 15 wherein the portable communication device is a WiMAX communication device.

17. The flat panel display of claim 16 wherein the portable communication device includes a WiMAX transceiver for communicating in accordance with an IEEE 802.16 standards.

18. A wireless communication device comprising:

a flat panel display comprising a housing, a flat display area, and one or more antenna structures provided within the housing; and a wireless transceiver coupled to the one or more antenna structures, wherein the one or more antenna structures comprise an upper radiating element and a rectangular lower radiating element separated from the upper radiating element by a vertical separation distance, and a rectangular conductive region disposed on the planar surface, the rectangular conductive region coupled to the rectangular lower radiating element and protruding from the rectangular lower radiating element, the rectangular lower radiating element disposed on a planar surface and a feed point, wherein the rectangular lower radiating element has a height greater than one-half of a height of the substrate, and the vertical separation distance is no greater than 0.06 wavelengths to provide an antenna pattern having donut-shape over a bandwidth from 2.5 to 3.8 GHz, and wherein when the flat display area and the planar surface are positioned vertically, far-field effects of current flowing in opposite directions on the upper radiating element cancel and far-field effects of current flowing in opposite directions on the lower radiating element cancel to provide the antenna pattern with increased gain in horizontal directions and reduced gain in vertical directions.

19. The wireless communication device of claim 18 wherein the upper radiating element comprises a straight conductive trace disposed on the planar surface of a non-conductive substrate, the rectangular lower radiating element serves as a ground plane disposed on the planar surface, and the feed point is provided between the upper and lower radiating elements, wherein the upper and lower radiating elements are provided in a planar configuration in a same plane as the planar surface, and wherein when the planar surface is positioned vertically and when the straight conductive trace of the upper radiating element is positioned horizontally, the antenna pattern having a donut-shaped radiation pattern with increased gain in the horizontal directions and reduced gain in the vertical directions is provided.

20. The wireless communication device of claim 18 wherein the wireless transceiver is a WiMAX transceiver configured to communicate in accordance with an IEEE 802.16 communication standard.

* * * * *